US006461229B2

(12) United States Patent
Heijkenskjöld

(10) Patent No.: US 6,461,229 B2
(45) **Date of Patent: *Oct. 8, 2002**

(54) ABRASIVE MACHINE FOR MACHINING A SURFACE OF A CYLINDRICAL WORK PIECE

(75) Inventor: Mats Heijkenskjöld, Lidköping (SE)

(73) Assignee: Lidköping Machine Tools AB, Lidköping (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/893,400

(22) Filed: Jun. 29, 2001

(65) Prior Publication Data

US 2002/0045408 A1 Apr. 18, 2002

Related U.S. Application Data

(63) Continuation of application No. PCT/SE99/02443, filed on Dec. 21, 1999.

(30) Foreign Application Priority Data

Dec. 30, 1998 (SE) ..... 9804617

(51) Int. Cl.[7] ..... B29B 1/00

(52) U.S. Cl. ..... 451/51; 451/27; 451/180; 451/56

(58) Field of Search ..... 451/51, 24, 11, 451/27, 21, 52, 56, 181, 180, 231, 259, 270, 444, 443

(56) References Cited

U.S. PATENT DOCUMENTS 4,112,624 A * 9/1978 Uhtenwoldt et al. ..... 451/72
4,656,789 A * 4/1987 Schwar ..... 451/246
4,934,104 A * 6/1990 Ibe ..... 451/210
5,205,078 A * 4/1993 Takara et al. ..... 451/11
6,241,590 B1 * 6/2001 Heijkenskjold ..... 451/181
6,322,423 B1 * 11/2001 Heijkenskjold ..... 451/27

FOREIGN PATENT DOCUMENTS

| | | |
|---|---|---|
| SE | 512 250 C2 | 2/2000 |
| WO | WO 99/01253 | 1/1999 |
| WO | WO 99/01254 | 1/1999 |
| WO | WO 99/01255 | 1/1999 |

* cited by examiner

*Primary Examiner*—Eileen P. Morgan
*Assistant Examiner*—Hadi Shakeri
(74) *Attorney, Agent, or Firm*—Burns, Doane, Swecker & Mathis, L.L.P.

(57) ABSTRACT

Machine for machining an envelope surface of a cylindrical work piece includes a tubular cylindrical housing with a longitudinal axis and having an inner space extending from a first end of the housing, and with an axis offset from the housing axis, a shaft angularly displaceable in the inner space and provided with a recess, and a motor in the recess. A spindle is coupled to the motor and carries a first rotatable tool, a rotatable outer casing encloses the housing, and a lid is arranged for co-rotation with the casing and extends radially over the first end of housing with the lid having a central through opening with the peripheral surface. A second rotated tool is disposed on the peripheral surface, and a support device is adapted to hold the work piece between the tools. The shaft is arranged to cause the first tool to effect radial displacement relative to the second rotated tool.

13 Claims, 5 Drawing Sheets

ABRASIVE MACHINE FOR MACHINING A SURFACE OF A CYLINDRICAL WORK PIECE

This application is a continuation of International Application No. PCT/SE99/02443 filed on Dec. 21, 1999, which International Application was published by the International Bureau in English on Jul. 13, 2000.

TECHNICAL FIELD

The present invention relates to an abrasive machine, in particular a grinder for removal of material from an envelope surface of a substantially cylindrical work piece, the machine comprising a rotatably driven tool.

BACKGROUND OF THE INVENTION

Abrasive machines such as grinding machines, lapping machines, honing machines, milling machines, etc., are known in many slightly different designs and embodiments. It is desirous that the machine be compact and as space-saving as possible. For obtaining good machining results, it is on the other hand important that the co-operating parts of the machine have a high mutual stiffness and low tendencies of vibration. These last-mentioned properties are often obtained by giving the machine a heavy bedding and a sturdy and robust design, and therefore these two requirements are often contradictory to the desires for compactness and space-saving properties.

It is known from Swedish Patent Application Nos 9702587-8 and 9702588-6 to provide abrasive machines which at least partially fulfil the above properties. In both said applications, a machine is provided which comprises a tubular cylindrical housing having a longitudinal cylindrical inner space. The cylindrical inner space has a longitudinal axis which is offset from the longitudinal axis of the housing. A shaft is arranged for angular displacement in the cylindrical inner space and has a recess accommodating a motor which is coupled to a rotatable work head. The work head together with the chucking equipment is arranged to hold and rotate a work piece to be treated. The housing is enclosed by a rotatably driven outer casing, with the casing being firmly connected to a lid member having an opening forming at its inner edge a tool, such as a grinding wheel. When the shaft is angularly displaced, the work head is displaced with the work piece in a path allowing the work piece to approach and contact the inner periphery of the tool.

The construction of the machines disclosed in said patent applications implies that the work piece and the tool are supported in a very stable manner since only very short distances are present between the work piece and the shaft which supports the work piece. Furthermore, the arrangement of the tool along the inner periphery of the lid member also implies that the tool exhibits high stability. As a result, these machines exhibit superior precision compared to conventional machines having long support shafts which are subject to vibration and thermal effects.

The machines according to said Swedish patent applications are designed to be able to grind the outer and inner envelope surfaces respectively of annular work pieces which can be gripped by conventional chucking equipment. A need exists, however, for a machine which is capable of removing material from an envelope surface of substantially cylindrical work pieces, for example rollers for bearings, which cannot reasonably be gripped by conventional chucking equipment.

SUMMARY OF THE INVENTION

This object is achieved by means of a machine in particular a grinder for removal of material from an envelope surface of a substantially cylindrical work piece, said machine comprising:

a tubular cylindrical housing extending about a longitudinal axis, said housing having a longitudinal cylindrical inner space extending from a first end of said housing, said cylindrical inner space having a longitudinal axis which is offset from the longitudinal axis of said housing;

a shaft arranged in said inner space for angular displacement therein, said shaft being provided with a recess;

a motor arranged in said recess;

a spindle coupled to said motor, said spindle carrying a first rotatably driven tool;

a rotatable outer casing peripherally enclosing said tubular cylindrical housing;

a lid member associated with said outer casing for co-rotation therewith, said lid member extending radially over a region of said first end of said tubular cylindrical housing with said lid member being provided with a central through opening having a peripheral surface;

a second rotatably driven tool disposed on said peripheral surface of said central through opening of said lid member, and support means for holding said work piece between said first and second rotatably driven tools;

wherein said shaft is arranged in said inner space such that when said shaft executes an angular displacement in said inner space, said first rotatably driven tool is caused to effect a radial displacement relative said second rotatably driven tool.

Preferred embodiments of the invention are detailed in the dependent claims.

BRIEF DESCRIPTION OF THE DRAWINGS:

The invention will be described in greater detail in the following by way of example only and with reference to embodiments shown in the attached drawings, in which.

Figure 1:
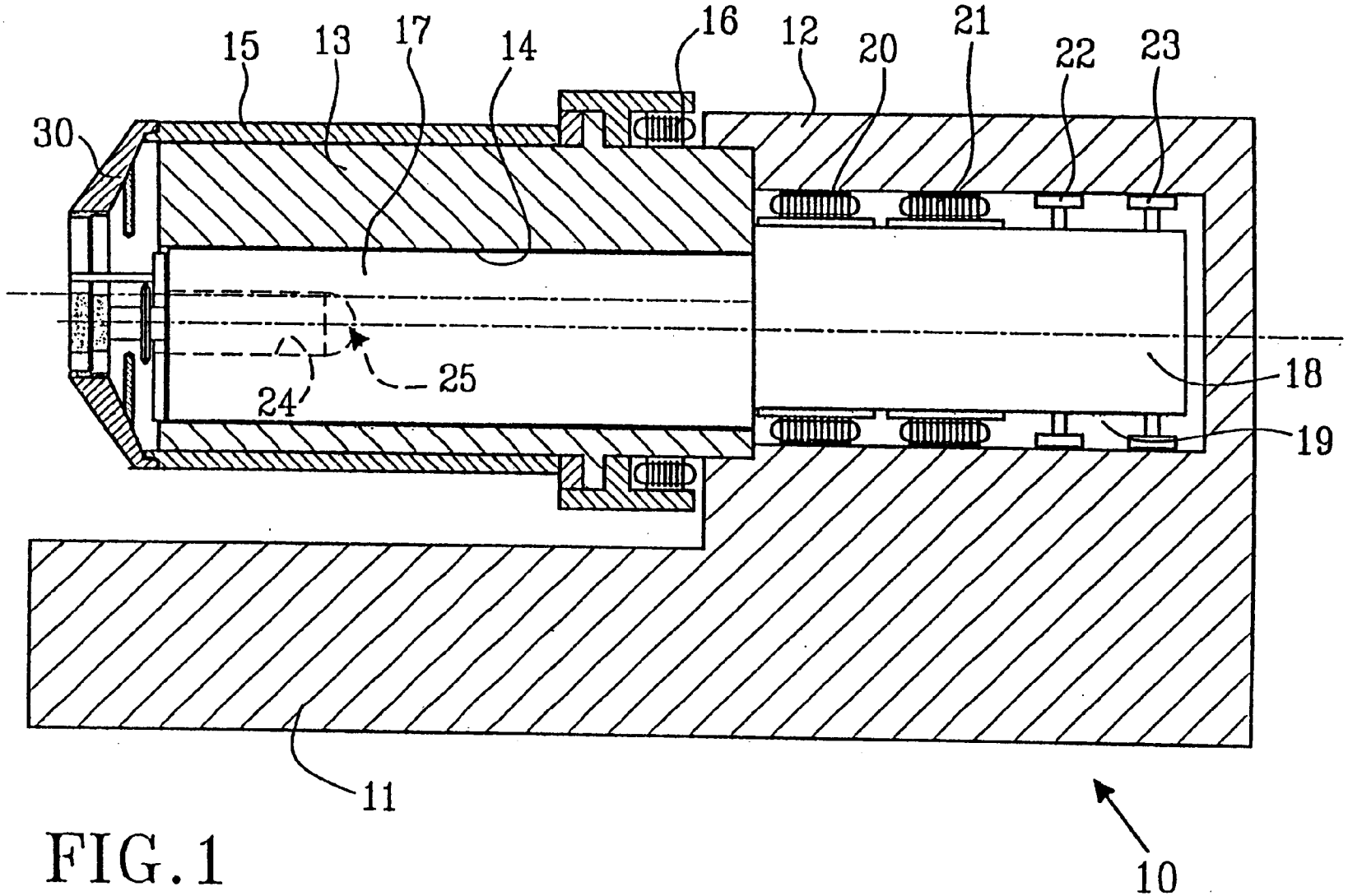
FIG. 1 shows in a schematic longitudinal sectional view a first embodiment of the abrasive machine according to the invention.

DETAILED DESCRIPTION OF PREFERRED EMBODIMENTS:

In the drawings, reference numeral 10 generally denotes an abrasive machine according to the present invention. The machine 10 incorporates a frame 11 which, in the shown embodiment, is designed as a machine bed having a portion 12 for supporting a cantilever housing. The cantilever housing is designed as an externally cylindrical and substantially tube-shaped elongate housing 13 extending about a longitudinal axis. The housing 13 is provided with a longitudinal cylindrical inner space 14 extending from a first end of the housing. The cylindrical inner space 14 has a longitudinal axis which is offset from the longitudinal axis of the cylindrical housing 13. The cylindrical housing 13 is preferably—although not necessarily—non-rotatably connected to the frame 11.

Rotatably supported on the outer envelope surface of the cylindrical housing 13 is a rotatable outer casing 15, a wheel carriage, which is driven by a motor 16, preferably an electric motor, carried by the housing 13. Inside the eccentric inner space 14 of the housing, there is provided a shaft 17 which can be revolved or indexed and displaced axially. In the shown embodiment the shaft 17 has a reduced diameter portion 18 projecting out from the housing inner space 14 in a direction towards the supporting portion 12 of the frame 11. The portion 18 of the shaft thus projecting from the housing is received in a space 19 provided in the supporting portion 12 of the frame 11, and in which space there is provided means for revolving the shaft 17, preferably a torque motor 20, and means for axial displacement of the shaft 17, preferably a linear motor 21. The revolving and the axial displacement of the shaft is controlled by one or more sensors 22 and 23 respectively, which preferably are also accommodated in the space 19 of the frame portion 12. It is evident that the means for revolving and axially displacing the shaft need not be arranged in a manner as shown in the drawings, but may for instance be contained in a recessed portion of the shaft itself.

At its end opposite the reduced diameter portion 18, the shaft 17 is provided with a recess 24. The recess extends substantially axially into the shaft 17 and is adapted to receive a motor 25, for example an electric motor. The motor 25 is provided with a spindle 26 which projects out of the recess 24. The motor is arranged within the recess such that the spindle 26 extends along an axis which is non-concentric with the longitudinal axis of the shaft 17. At its end 27 remote from the motor 25, the spindle 26 carries a first rotatably driven tool 28.

Figure 2:
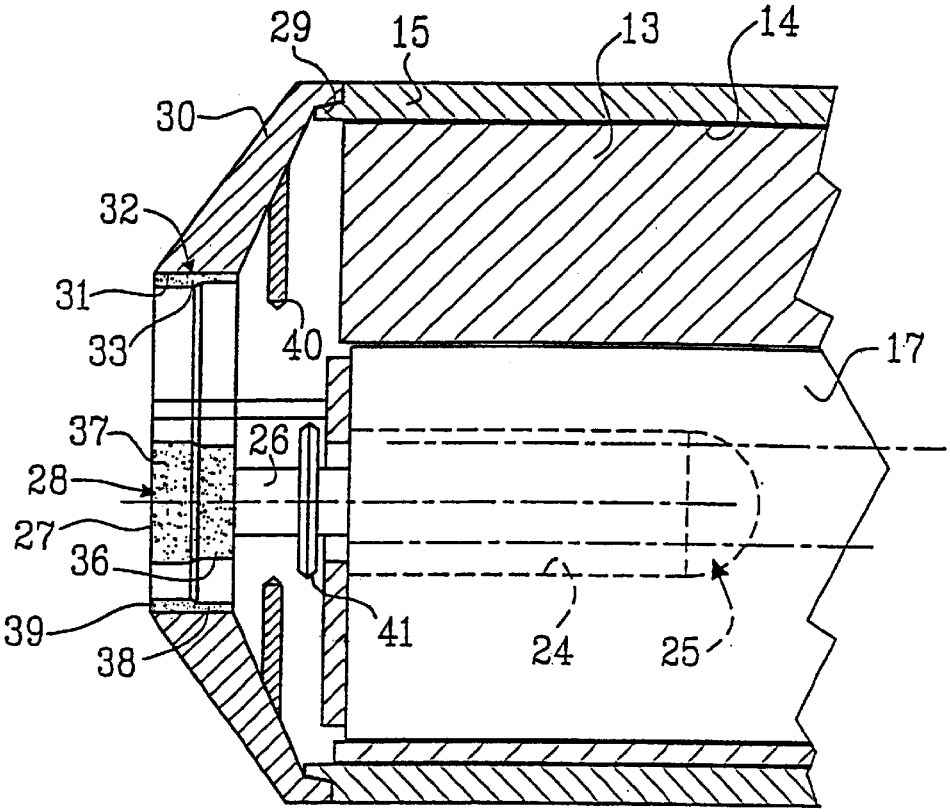
FIG. 2 is a schematic longitudinal sectional view on a greater scale of a part of the abrasive machine of FIG. 1.
Figure 3:
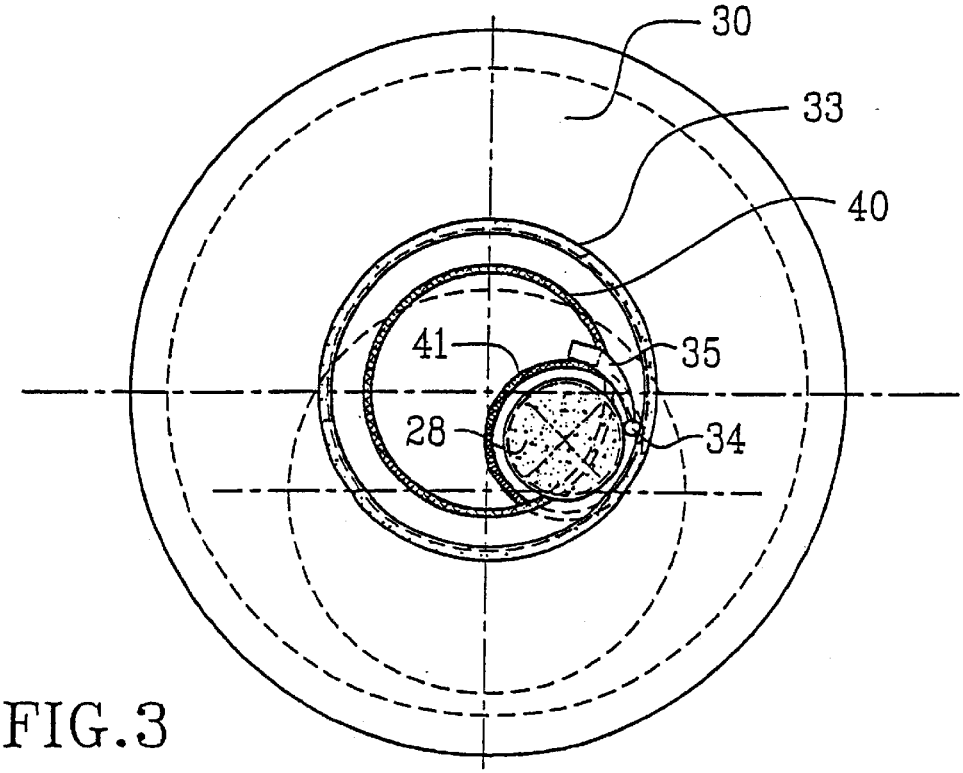
FIG. 3 is an end view of the embodiment shown in FIG. 2.
Figure 4:
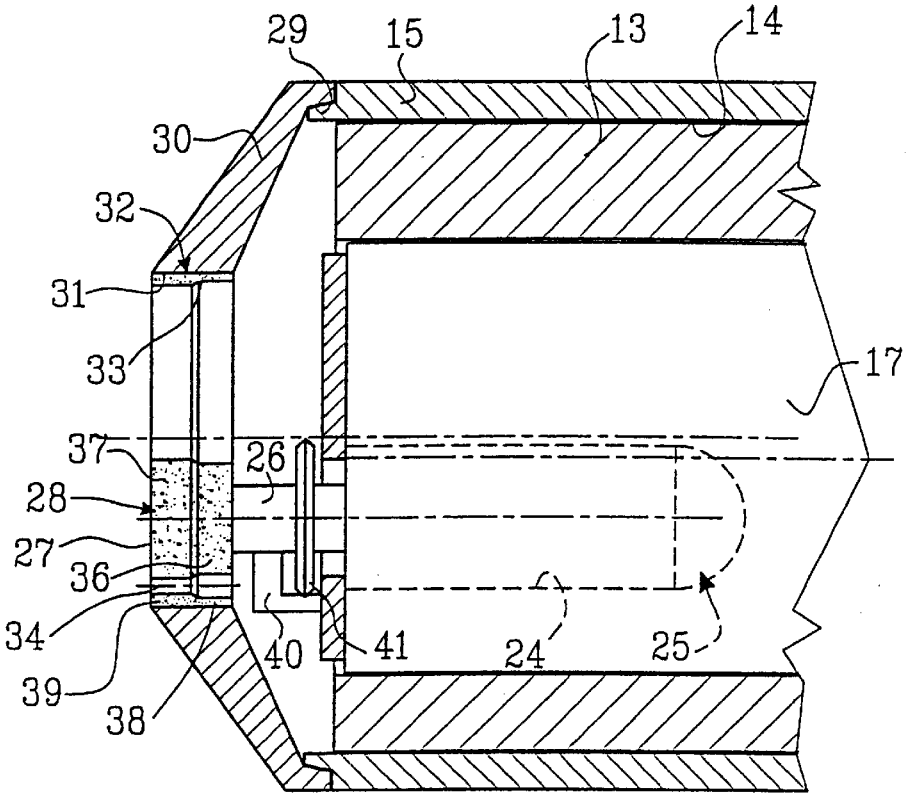
FIG. 4 is a view corresponding to FIG. 2, though of a second embodiment of the abrasive machine according to the invention.

As is most clearly apparent from FIGS. 2 and 4, the rotatable outer casing 15 or wheel carriage, extends axially beyond the first end of the housing 13 and terminates in a peripheral flange 29. A lid member 30 is firmly connected to the outer casing 15 via the peripheral flange 29 such that the lid member is able to co-rotate with the outer casing. The lid member 30 extends radially over a region of the first end of the tubular cylindrical housing 13 with the lid member being provided with a central through opening 31 having a peripheral surface 32. A second rotatably driven tool 33 is disposed on the peripheral surface 32 of the central through opening 32 of the lid member 30. As is apparent from FIGS. 2, 3 and 5, a work piece 34 is arranged to be held between the first and second rotatably driven tools 28, 33 by support means 35 connected to the shaft 17.

In accordance with the present invention, the shaft 17 is arranged in the inner space 14 such that when the shaft executes an angular displacement in the inner space, the first rotatably driven tool 28 is caused to effect a radial displacement relative the second rotatable driven tool 33.

In the embodiments illustrated in FIGS. 1 to 5, the abrasive machine 10 is arranged to machine an outer envelope surface of the work piece 34. Thus, the first rotatably driven tool 28 functions as a control wheel and serves primarily to effect rotation of the work piece 34 and to hold the work-piece against the second rotatably driven tool 33, the second rotatably driven tool acting as a grinding wheel. As such, the first rotatably driven tool 28 does not necessarily have to have an abrasive surface, though it is advantageous if the surface has a sufficiently high coefficient of friction to ensure rotation of the work piece. The shape of the first rotatably driven tool 28 is selected depending on the shape of the work piece to be machined. In a preferred embodiment, the first rotatably driven tool 28 comprises a first region 36 of first diameter extending a first axial distance and a second region 37 of second diameter extending a second axial distance, the second diameter being greater than the first diameter. In a similar manner, the second rotatably driven tool 33 may comprise a first region 38 of first diameter extending a first axial distance and a second region 39 of second diameter extending a second axial distance, the first diameter being greater than the second diameter. Advantageously, the difference between the first and second diameter of the first rotatably driven tool 28 is substantially equal to the difference between the first and second diameter of the second rotatably driven tool 33. This described arrangement implies that a work piece 34 of substantially cylindrical shape, though having regions of differing diameter, may have its entire envelope surface machined simultaneously. Nevertheless, it is to be understood that the first and second rotatably driven tools 28, 33 may also comprise differing numbers of regions of different diameters. Although the first and second rotatably driven tools can have differing axial extensions, maximum usage of the axial surfaces of the first and second rotatably driven tools can be obtained when the first axial distance of the first rotatably driven tool 28 is substantially equal to the first axial distance of said second rotatably driven tool 33, and the second axial distance of the first rotatably driven tool is substantially equal to the second axial distance of the second rotatably driven tool.

In order to ensure that the work piece 34 is imparted the correct shape, the machine 10 comprises a first dressing tool 40 for dressing the first rotatably driven tool 28. In the embodiment shown in FIGS. 2 and 3, the first dressing tool 40 is carried by the lid member 30 and is annular in form. Thus, the spindle 26 of the motor 25 extends through the first dressing tool 40. In an alternative embodiment illustrated in FIGS. 4 and 5, the first dressing tool 40 is in the form of an arm carried by the tubular cylindrical housing 13. Advantageously, the machine 10 further comprises a second dressing tool 41 for dressing the second rotatably driven tool 33, the second dressing tool being in the form of a disc carried by the spindle 26 of the motor 25. Advantageously, the first and second dressing tools 40, 41 may comprise a diamond-based abrasive material.

Figure 5:
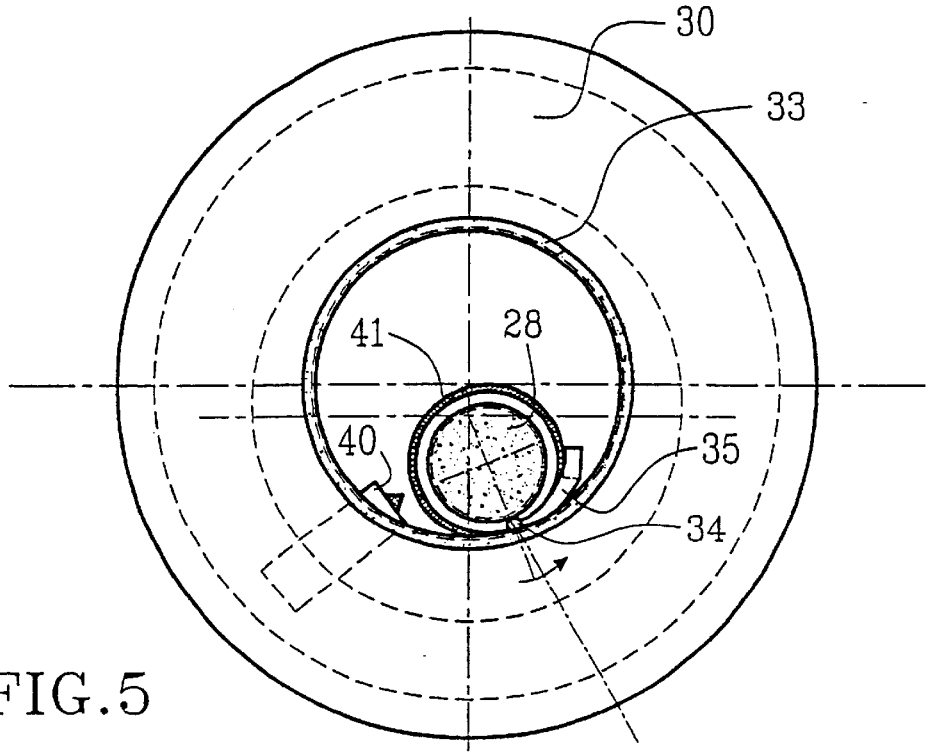
FIG. 5 is an end view of the embodiment shown in FIG. 4.
Figure 6:
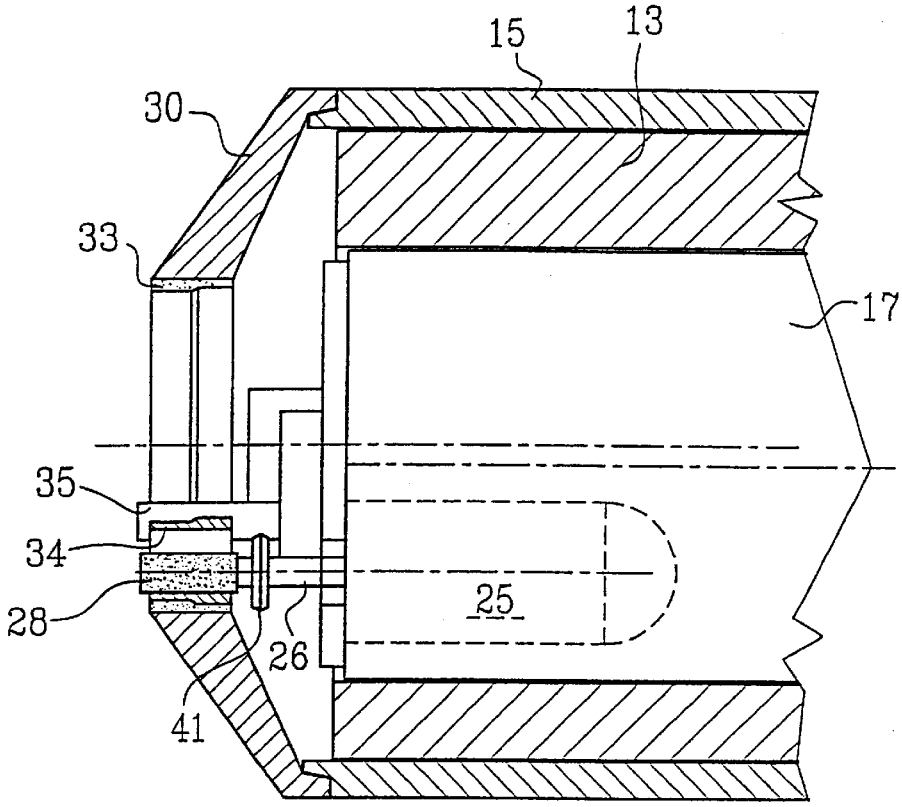
FIG. 6 is a schematic longitudinal sectional view of a third embodiment of the abrasive machine according to the invention.
Figure 7:
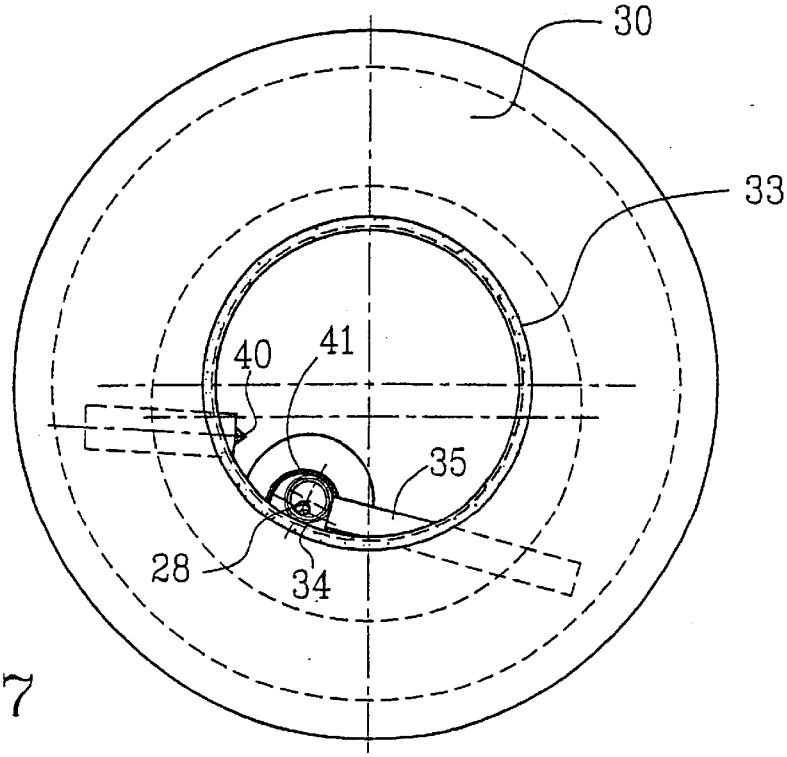
FIG. 7 is an end view of the embodiment shown in FIG. 6.
Figure 8:
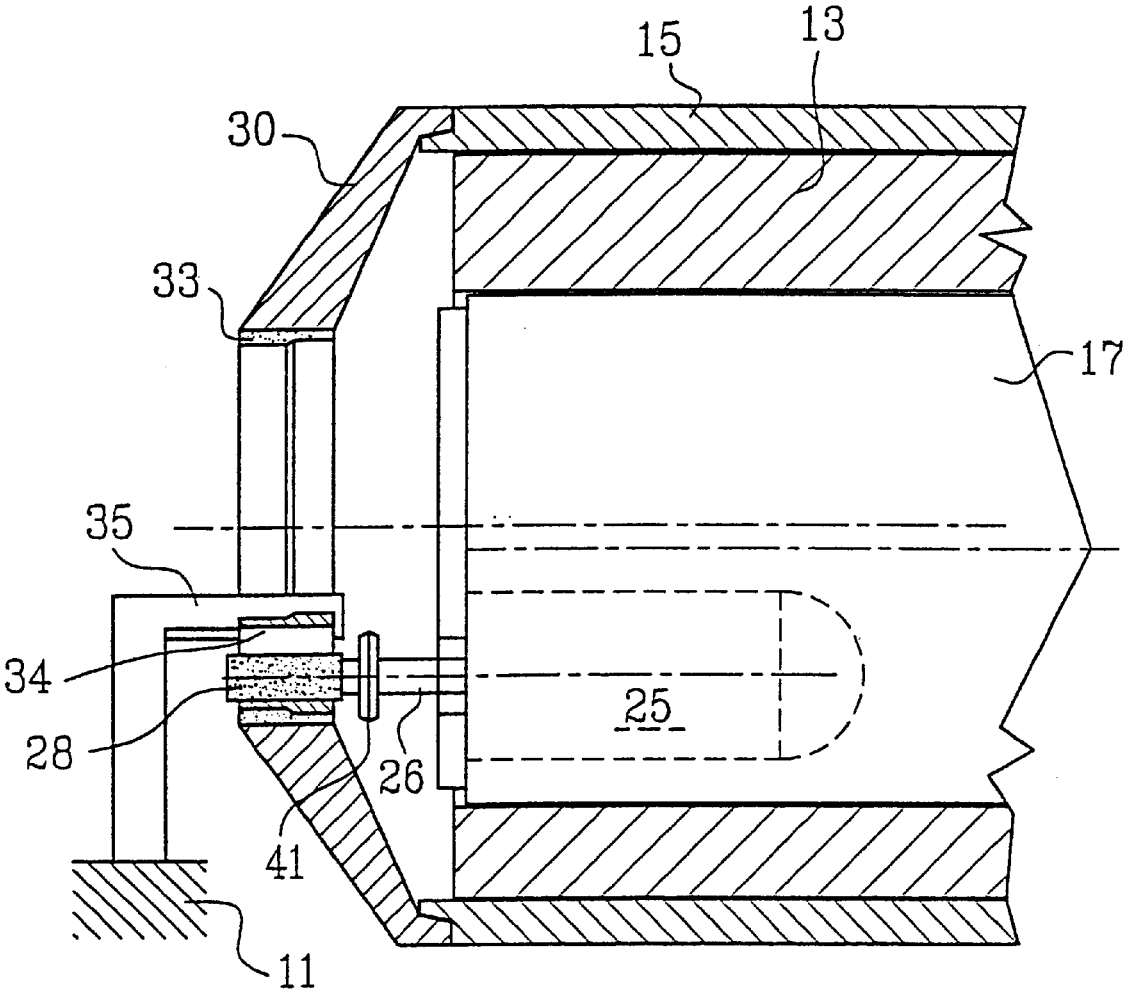
FIG. 8 is a view corresponding to FIG. 6, though of a further embodiment of the abrasive machine according to the invention.

The abrasive machine illustrated in FIGS. 6 to 8 differs from that of FIGS. 1 to 5 in that the machine is arranged to machine an inner envelope surface of the work piece 34. To this effect, the first rotatably driven tool 28 serves as a grinding wheel and is of sufficiently small diameter to pass within the work piece. The second rotatably driven tool 33 thereby serves as a control wheel. In the embodiment shown in FIGS. 6 and 7, the work piece is prevented from peripheral migration by the support means 35 connected to the housing 13 in the FIG. 8 embodiment, on the other hand, the support means extends away from the housing 13 and is instead connected to the frame 11 of the machine. As shown in FIG. 7, the machine 10 for machining an internal envelope surface may have a first dressing tool 40 carried by the tubular cylindrical housing 13. Alternatively, the first dressing tool 40 may be carried by the lid member 30 in a manner corresponding to that shown in FIG. 2.

With particular reference to FIGS. 3 and 5, the machine 10 for machining an external envelope surface is operated in the following manner.

To insert the work piece 34, the shaft 17 within the tubular cylindrical housing 13 is caused to rotate anti-clockwise to thereby increase the distance between the first and second rotatably driven tools 28, 33 such that a gap is created which is sufficient to accommodate the work piece. The work piece 34 is inserted into this gap such that it abuts the support means 35. Thereafter, the shaft 17 is rotated clockwise such that the first rotatably driven tool 28 approaches the second rotatably driven tool 33 until the first rotatably driven tool contacts the work piece. During both the insertion of the work piece 34 and its machining, the rotatable outer casing 15 rotates anti-clockwise at a speed of, for example, 1000 rpm. Due to the connection between the lid member 30 and the outer casing 15, the second rotatably driven tool 33 is caused to rotate at the same speed. At the same time that the second rotatably driven tool is rotated, the first rotatably driven tool 28 rotates clockwise at a lower speed than the second tool, for example 100 rpm. The differences in rotational speed and direction between the two tools cause the work piece 34 to be pressed against the support means 35 and revolved as machining of the envelope surface of the work piece takes place. Advantageously, at least the second rotatably driven tool 33 comprises an abrasive material such as Cubic Boron Nitride so that the envelope surface of the work piece is abraded. The contact force between the work piece and the two rotatably driven tools can be regulated by rotating the shaft 17 clockwise or anti-clockwise to thereby vary the gap between the two tools.

Once machining is completed, the shaft 17 is displaced anti-clockwise and the work piece 34 is removed and replaced by the next work piece to be machined.

With reference to FIGS. 6 to 8, the machine 10 for machining an inner envelope surface is operated in the following manner.

To insert the work piece 34, the shaft 17 within the tubular cylindrical housing 13 is displaced axially to the left as shown in the drawings so that the first rotatably driven tool 28 becomes axially spaced from the second rotatably driven tool 33. The work piece 34 is then placed on the second rotatably driven tool 33 and abuts the support means 35. The shaft 17 is caused to rotate clockwise to thereby increase the distance between the first and second rotatably driven tools 28, 33 such that the first rotatably driven tool can be inserted within the work piece by an axial displacement of the shaft 17 to the right in the drawings without the first rotatably driven tool fouling the work piece. Thereafter, the shaft 17 is rotated anti-clockwise such that the first rotatably driven tool 28 approaches the second rotatably driven tool 33 until the distance between the first and second rotatably driven tools corresponds to the wall thickness of the work piece 34. The rotatable outer casing 15 rotates clockwise at a speed of, for example, 100 rpm. Due to the connection between the lid member 30 and the outer casing 15, the second rotatably driven tool 33 is caused to rotate at the same speed. At the same time that the second rotatably driven tool is rotated, the first rotatably driven tool 28 rotates anti-clockwise at a higher speed than the second tool, for example 30,000 rpm. The differences in rotational speed and direction between the two tools cause the work piece 34 to be pressed against the support means 35 and revolved as machining of the inner envelope surface of the work piece takes place. Advantageously, at least the first rotatably driven tool 28 comprises an abrasive material such as Cubic Boron Nitride so that the inner envelope surface of the work piece is abraded. The contact force between the work piece and the two rotatably driven tools can be regulated by rotating the shaft 17 clockwise or anticlockwise to thereby vary the gap between the two tools.

Once machining is completed, the shaft 17 is displaced clockwise, the work piece 34 is removed and replaced by the next work piece to be machined.

Irrespective of whether the machine 10 is used for machining inner or outer envelope surfaces, dressing of the first and second rotatably driven tools is effected in the same manner. To dress the first rotatably driven tool 28, the shaft 17 is axially displaced to the left as shown in FIGS. 2, 4, 6 and 8 to cause the first rotatably driven tool to be withdrawn into a space defined by the cylindrical housing 13 and the lid member 30. By effecting rotation of the shaft 17, the first rotatably driven tool 28 can be caused to contact the first dressing tool 40. Naturally, in the FIG. 2 embodiment, dressing takes place with the lid member 30, and hence the dressing tool 40, and the first rotatably driven tool 28 revolving whilst in the FIG. 4 embodiment only the first rotatably driven tool is revolving.

To dress the second rotatably driven tool 33, the shaft 17 is axially displaced to the right as shown in FIGS. 2, 4, 6 and 8 to cause the second dressing tool 41 to enter the central opening 31 in the lid member 30. By effecting rotation of the shaft 17, the second dressing tool 41 can be caused to approach and contact the second rotatably driven tool 33. Naturally, dressing takes place with both the second dressing tool 41 and the second rotatably driven tool 33 revolving.

The invention is not limited to the embodiment described above and shown in the drawings. Instead, all modifications and variations within the scope of the appended claims are to be deemed to be covered. For example, the cylindrical housing 13 has been shown having a cylindrical inner space. This space may also have a shape other than a cylindrical shape and the shaft 17 may have any appropriate cross-sectional shape which allows it to be turned or indexed within the inner space of the housing. The portion 18 of the shaft 17 received in the space 19 need not have a reduced diameter. It is further conceivable that the shaft be substituted for a system of articulated links or the like capable of turning or indexing the spindle in an appropriate manner.

What is claimed is:

1. An abrasive machine for removal of material from an envelope surface of a substantially cylindrical work piece comprising:

a tubular cylindrical housing extending about a longitudinal axis, said housing having a longitudinal cylindrical inner space extending from a first end of said housing, said cylindrical inner space having a longitudinal axis which is offset from the longitudinal axis of said housing;

a shaft arranged in said inner space for angular displacement therein, said shaft being provided with a recess;

a motor arranged in said recess;

a spindle coupled to said motor, said spindle carrying a first rotatably driven tool;

a rotatable outer casing peripherally enclosing said tubular cylindrical housing;

a lid member associated with said outer casing for co-rotation with said outer casing, said lid member extending radially over a region of said first end of said tubular cylindrical housing with said lid member being provided with a central through opening having a peripheral surface;

a second rotatably driven tool disposed on said peripheral surface of said central through opening of said lid member, and support means for holding said work piece between said first and second rotatably driven tools;

wherein said shaft is arranged in said inner space such that when said shaft executes an angular displacement in said inner space, said first rotatably driven tool is caused to effect a radial displacement relative said second rotatably driven tool.

2. The machine as claimed in claim 1, wherein said first rotatably driven tool is adapted to act on an outer envelope surface of the work piece.

3. The machine as claimed in claim 1, wherein said first rotatably driven tool is adapted to act on an inner envelope surface of the work piece.

4. The machine as claimed in claim 1, wherein said first rotatably driven tool comprises a first region of first diameter extending a first axial distance and a second region of second diameter extending a second axial distance, said second diameter being greater than said first diameter.

5. The machine as claimed in claim 4, wherein said second rotatably driven tool comprises a first region of first diameter extending a first axial distance and a second region of second diameter extending a second axial distance, said first diameter being greater than said second diameter.

6. The machine as claimed in claim 5, wherein the difference between said first and second diameter of said first rotatably driven tool is substantially equal to the difference between said first and second diameter of said second rotatably driven tool.

7. The machine as claimed in claim 6, wherein said first axial distance of said first rotatably driven tool is substantially equal to said first axial distance of said second rotatably driven tool, and said second axial distance of said first rotatably driven tool is substantially equal to said second axial distance of said second rotatably driven tool.

8. The machine as claimed in claim 1, wherein said machine comprises a first dressing tool for dressing said first rotatably driven tool.

9. The machine as claimed in claim 8, wherein said first dressing tool is carried by said lid member and is annular.

10. The machine as claimed in claim 8, wherein said first dressing tool is carried by said tubular cylindrical housing.

11. The machine as claimed in claim 1, wherein said machine comprises a second dressing tool for dressing said second rotatably driven tool, said second dressing tool being carried by said spindle.

12. The machine as claimed in claim 1, wherein said machine comprises means for axially displacing said shaft with respect to said tubular cylindrical housing.

13. The machine as claimed in claim 12, wherein said shaft is provided with sensors for controlling rotational and axial displacement of said shaft.

* * * * *